US006840076B2

(12) United States Patent
Noe et al.

(10) Patent No.: US 6,840,076 B2
(45) Date of Patent: Jan. 11, 2005

(54) STRIP TREATING LINE FOR LEVELING METAL STRIP

(75) Inventors: Andreas Noe, Kerken (DE); Rolf Noe, Mülheim/Ruhr (DE)

(73) Assignee: BWG Bergwerk—Und Walzwerk-Maschinenbau GmbH, Duisburg (DE)

( * ) Notice: Subject to any disclaimer, the term of this patent is extended or adjusted under 35 U.S.C. 154(b) by 52 days.

(21) Appl. No.: 10/128,659

(22) Filed: Apr. 22, 2002

(65) Prior Publication Data

US 2002/0162375 A1 Nov. 7, 2002

(30) Foreign Application Priority Data

May 5, 2001 (DE) ..... 101 21 981

(51) Int. Cl.[7] ..... B21B 39/08
(52) U.S. Cl. ..... 72/205; 72/161
(58) Field of Search ..... 72/205, 8.7, 9.1, 72/9.2, 11.7, 11.8, 161, 164

(56) References Cited

U.S. PATENT DOCUMENTS 3,457,748 A * 7/1969 Wistreich ..... 72/8.7
4,079,615 A * 3/1978 Noe ..... 72/205
4,311,030 A * 1/1982 Kitashima et al. ..... 72/9.1
4,819,470 A * 4/1989 Noe et al. ..... 72/161
5,341,664 A * 8/1994 Noe et al. ..... 72/161
6,109,084 A * 8/2000 Hutzenlaub et al. ..... 72/205

FOREIGN PATENT DOCUMENTS

DE 35 25 343 12/1986
DE 196 45 599 5/1998
JP 55081011 A * 6/1980 ..... B21B/37/00
JP 01166807 A * 6/1989 ..... B21B/13/14
JP 01219507 A * 9/1989 ..... G01B/21/20
JP 04251608 A * 9/1992 ..... B21B/39/08

* cited by examiner

*Primary Examiner*—Lowell A. Larson
(74) *Attorney, Agent, or Firm*—Herbert Dubno

(57) ABSTRACT

A strip treatment line in which downstream of the processing roll stand for stainless steel strip, first and second tension rolls are provided to directly form a prestretching zone A for elastic or elastoplastic stretching of the strip following the dressing mill stand and for providing an afterstretching zone with elastoplastic or plastic stretching of the strip.

8 Claims, 2 Drawing Sheets

STRIP TREATING LINE FOR LEVELING METAL STRIP

FIELD OF THE INVENTION

Our present invention relates to a strip treating line for leveling of metal strip and, more particularly, high quality steel strip and especially stainless steel strip.

BACKGROUND OF THE INVENTION

In the processing of high quality steel strip and especially stainless steel strip, it is common to subject a cold-rolled, annealed and pickled or bright annealed strip to leveling during the processing.

The strip processing line thus can include a dressing mill stand, i.e. a mill stand which subjects the strip to only a minimum of thickness reduction, followed by one or more zones in which tension or stretch leveling occurs. For example, between the dressing mill stand and a pair of rolls looped by the workpiece steel strip, e.g. a bridle, a stretching zone is formed in which the strip tension is raised from the level of the strip tension as the strip is drawn through the dressing mill stand to a level at which the stretch leveling occurs.

This has been found to be successful in practice. However, basic to the use of bridles and rolls to increase the strip tension or to bring the strip tension from one level to another, is the problem of damage to the surface of the strip since each roll encountered by the strip introduces the possibility of such damage to the surface.

OBJECT OF THE INVENTION

It is, therefore, the principal object of the present invention to provide an improved stretch leveler system in a strip treatment line of the aforedescribed type whereby the danger of surface damage to the treated strip can be reduced. More specifically it is an object of the invention to provide a strip treatment line for metal strip of the aforedescribed type which can assure a high degree of planarity of the strip to be leveled while minimizing the risk of damage to the strip surface.

SUMMARY OF THE INVENTION

These objects are achieved, in accordance with the invention in a strip treatment line for leveling metal strip, especially high quality steel strip and most importantly stainless steel strip which comprises the steps of:

- a dressing mill stand having a pair of dressing rolls between which a workpiece metal strip passes for reduction to a dressed thickness; and
- a first roll directly downstream of the dressing mill stand and looped by the workpiece metal strip immediately upon traversing the dressing mill stand and applying tension to the workpiece metal strip, and a second roll spaced downstream of the first roll and looped by the workpiece metal strip immediately upon passing around the first roll and applying tension to the workpiece metal strip, whereby the first and second rolls form a tension-producing stretching roll pair forming a strip prestretching zone between the dressing mill stand and the first roll and a strip afterstretching zone between the first and second rolls.

With the system of the invention the dressing mill stand is followed by two rolls applying tension to the strip and referred to above as the first and second rolls without an intermediate bridle for increasing the tension as has hitherto been necessary. Between the dressing mill stand and the first roll of the stretching roll pair, a prestretching zone is created and between the first and second rolls of the stretching roll pair a first afterstretching zone is provided.

The prestretching zone can be operated either as an elastic stretching zone for the strip close to the elastic limit or as a plastic or elastoplastic or semiplastic stretching zone.

In the afterstretching zone, a plastic or elastoplastic stretching of the strip is effected.

To the extent that the strip tension must be increased from that at the outlet side of the dressing mill stand, the prestretching zone can serve directly for that purpose and can use the first tension applying roll of the stretching roll pair. Since the separate bridle or roll set for raising the strip tension from the level of the dressing mill stand to the level at which the stretching is to take place is thereby completely eliminated, the number of tension-applying rolls is reduced and therewith also the risk of damage to the strip surface. Naturally there is a concomitant reduction in cost corresponding to the number of tension rolls or bridles which can be eliminated.

Surprisingly, the elimination of a bridle or tension roll set between the dressing mill stand and the stretch-producing roll set does not adversely affect planarity. In fact it has been found that with the system of the invention excellent planarity results are obtainable utilizing the prestretching in combination with at least one afterstretching zone whereby the prestretching with the invention occurs directly downstream of the dressing roll stand and up to the first tension roll of the stretching roll depth.

Preferably ahead of the dressing mill stand, there is provided a first set of rolls (at least one bridle and preferably two bridles) capable of maintaining tension in the strip. This set of rolls can be, therefore, a braking roll set. Upstream of the stretching roll pair, we can provide a tensioning roll set, again at least one (and preferably two bridles) around which the strip is looped. The sets of braking and tensioning rolls further improve planarity and permit an optimum planarity to be obtained, especially when between the stretching roll pair and the tensioning roll set a second afterstretching zone is provided in which a plastic or elastoplastic or semiplastic stretching is effected as in the first afterstretching zone. In this case a plurality of elastoplastic or semiplastic afterstretching zones will follow an elastic or elastoplastic prestretching.

At least one of the rolls of the stretching roll pair can have a concave or convex contour and, indeed it has been found that it is possible to provide concave or convex contours for a multiplicity of the rolls following the dressing roll stand or to provide each of these rolls with an adjustable camber, i.e. a convex or concave profile which can be adjusted online.

Downstream of the dressing rolls and one or more planarity measuring devices can be provided. For example, one planarity measuring device can be provided between the dressing roll stand and the first tension roll and a second planarity measuring device can be provided between the stretching roll pair and the downstream set of tensioning rolls. The measured values can be supplied on an online basis to the controller which regulates the prestretching and leveling process.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
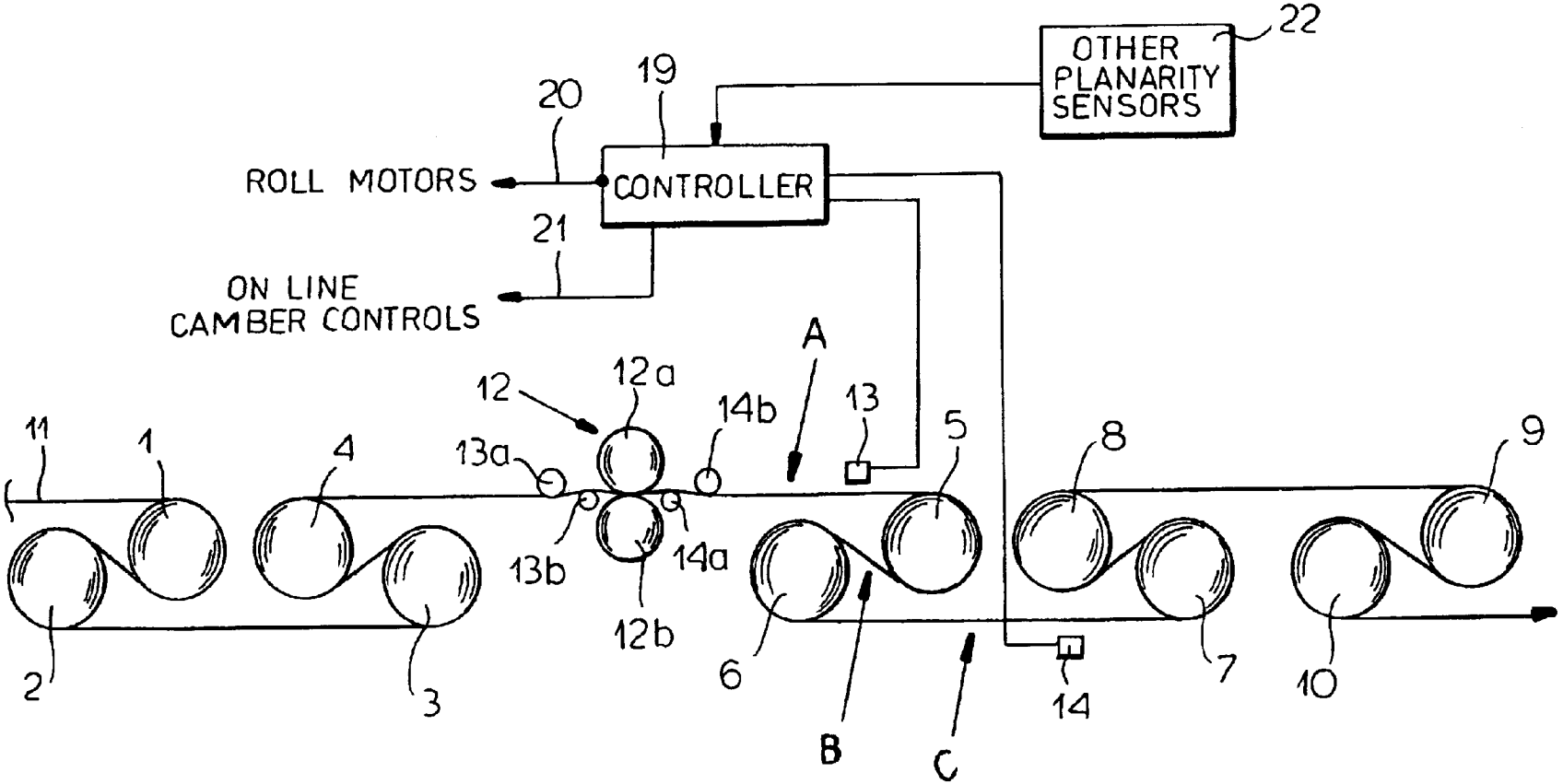
FIG. 1 is a diagrammatic side elevational view of a leveling line according to the invention.

FIG. 1 shows a strip processing line for processing a stainless steel strip 11 which derives from cold rolling of stainless steel following annealing and pickling or bright annealing. The strip is passed through a dressing mill stand 12 and which is slightly reduced in thickness between the rolls 12*a* and 12*b* and can pass under and over rolls 13*a* and 13*b* at the entrance to the mill stand and over and under rolls 14*a* and 14*b* upon exiting the mill stand.

After traversing the mill stand 12 the strip is looped around two tension rolls 5, 6 which form a bridle and which are driven at successively higher speeds. Thus the strip is directly passed first into a prestretching zone A between the dressing mill stand 12 and the first tension roll 5 and a second or afterstretching zone B between the first tension roll 5 and the second tension roll 6.

In the prestretching zone A, an elastic stretching of the strip 11 is effected up to or just below the elastic limit. An elastoplastic stretching is also possible in zone A. In the afterstretching zone B an elastoplastic stretching is carried out.

Upstream of the dressing mill stand 12, we provide a braking roll set 1, 2, 3, 4, in the form of rolls 1 and 2 forming a first bridle and rolls 3 and 4 forming a second bridle.

Downstream of the stretching roll pair 5, 6 is a second tension roll set 7, 8, 9, 10, operating at a speed greater than the roll 6 so that a further afterstretching zone C is provided between roll 6 and 7. The rolls 7, 8 and the rolls 9, 10 can form respective bridles.

Figure 2:
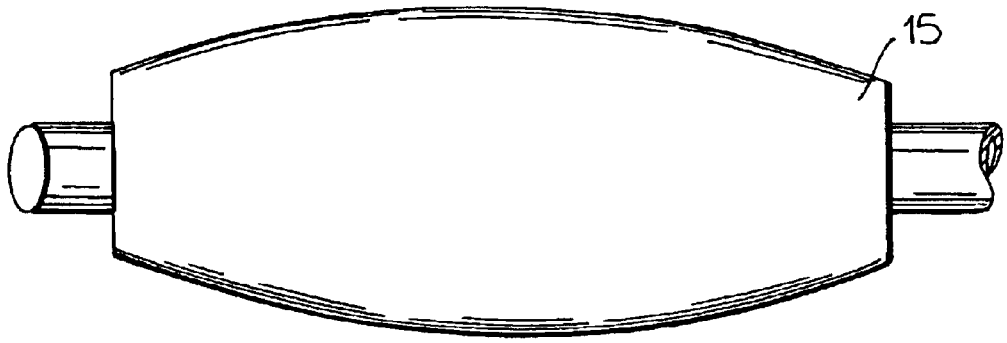
FIG. 2 is an elevational view of one of the tension rolls of the prestretching roll pair showing a convex camber.
Figure 3:
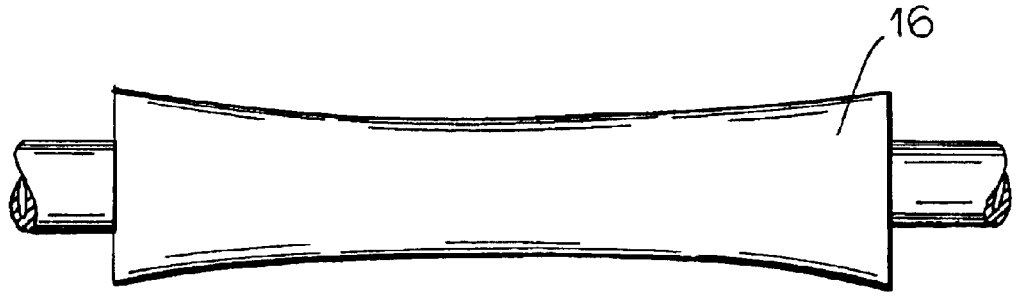
FIG. 3 is an elevational view of one of the tension rolls of the prestretching roll pair showing a concave camber.
Figure 4:
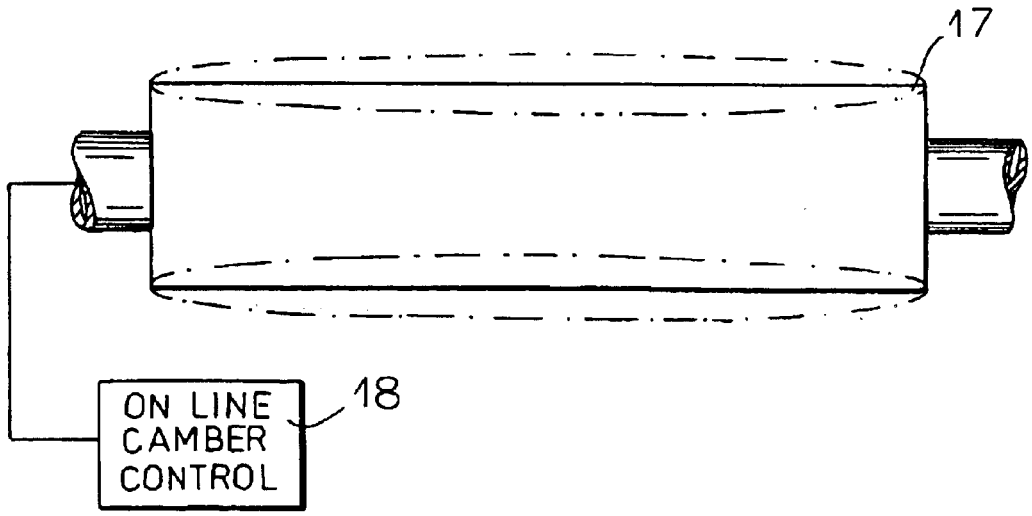
FIG. 4 is an elevational view of one of the tension rolls of the prestretching roll pair showing a variable camber.

As shown in FIGS. 2, 3 and 4, the rolls 5 an 6 can be either of a convex pair as shown at 15, a concave pair as shown at 16 or of a variable camber as shown at 17, regulated by an online camber control 18.

In the prestretching zone A and the second after stretching zone C, respective planarity measurement devices 13 and 14 can be provided to provide inputs to a controller 19 which has outputs 20 to the individual roll motors and at 21 to online camber controllers. Other planarity sensors may be provided as shown at 22 to afford inputs to the controller for the overall control of the stretching process.

We claim:

1. A strip treatment line for leveling metal strip comprising:

an upstream roll set comprising two two-roll bridles each looped by a high-quality steel strip and braking passage of said strip for maintaining tension therein;

a dressing mill stand having a pair of dressing rolls engaging said strip between them and located downstream of said upstream roll set, said dressing rolls being constructed and arranged for thickness reduction of said strip to a dressed thickness;

a first roll directly downstream of said dressing mill stand and looped by said strip immediately upon said strip traversing said dressing roll stand and constructed and arranged for applying tension and stretch to said strip so as to effect an elastic stretching of said strip close to an elastic limit of said strip or an elastoplastic or plastic stretching of said strip between said dressing mill stand and said first roll;

a second roll spaced downstream of said first roll and looped by said strip immediately upon said strip passing over said first roll, said second roll being constructed and arranged to apply tension and stretch to said strip between said first and second rolls, said first and second rolls being configured to effect elastoplastic or plastic stretching of said strip between said first and second rolls, said first and second rolls forming a stretching roll pair, and a downstream roll set comprising two two-roll bridles each looped by said strip downstream of said stretching roll pair for generating tension in said strip between said roll sets.

2. The strip treatment lined defined in claim 1 wherein said stretching roller pair and the downstream roll set are constructed and arranged for elastoplastic stretching of the strip between said stretching roll pair and said downstream roll set.

3. The strip treatment line defined in claim 2 wherein at least one of said first and second rolls has a concave or convex contour.

4. The strip treatment line defined in claim 3 wherein at least one of said first and second rolls is provided with an online adjuster for the roll contour.

5. The strip treatment line defined in claim 4, further comprising at least one strip planarity measuring device downstream of said dressing mill stand.

6. The strip treatment line defined in claim 5 wherein one of said strip planarity measuring devices is disposed between said dressing mill stand and said stretching roll pair.

7. The strip treatment line defined in claim 6 wherein a further one of said strip planarity measuring devices is provided downstream of said stretching roll pair.

8. The strip treatment line defined in claim 7, further comprising a controller for controlling stretching of said workpiece strip and connected to and receiving inputs from said strip planarity measuring devices.

* * * * *